US005256091A

United States Patent [19]

Haman et al.

[11] Patent Number: 5,256,091

[45] Date of Patent: Oct. 26, 1993

[54] SHIFT INTERLOCK SYSTEM

[75] Inventors: David F. Haman, Waukegan; Chester G. DuBois, Zion, both of Ill.

[73] Assignee: Outboard Marine Corporation, Waukegan, Ill.

[21] Appl. No.: 788,507

[22] Filed: Nov. 6, 1991

[51] Int. Cl.[5] ..... F02N 15/06

[52] U.S. Cl. ..... 440/85; 74/850; 123/179.23

[58] Field of Search ..... 440/75, 89, 87, 480 R, 440/480 B, 477, 850, 872, 873; 123/179.3, 179.23, 185.5

[56] References Cited

U.S. PATENT DOCUMENTS

| | | | |
|---|---|---|---|
| 2,723,655 | 11/1955 | Shimanckas | 74/534 |
| 3,518,979 | 7/1970 | Harkness | 123/179 |
| 3,866,591 | 2/1975 | Burmeister et al. | 123/179 K |
| 3,906,921 | 9/1975 | Tillotson et al. | 123/179 K |
| 3,942,505 | 3/1976 | Tillotson | 123/179 K |
| 3,971,353 | 7/1976 | Harkness et al. | 123/179 K |
| 4,103,660 | 8/1978 | Reese | 123/179 K |
| 4,167,929 | 9/1979 | DuBois | 123/179 K |
| 4,534,739 | 8/1985 | Slattery | 440/84 |
| 4,959,482 | 10/1990 | Mauz | 74/850 |

*Primary Examiner*—Sherman Basinger
*Assistant Examiner*—Clifford T. Bartz
*Attorney, Agent, or Firm*—Welsh & Katz

[57] ABSTRACT

A shift interlock system for preventing the starting of an outboard motor when the motor is in gear, the outboard motor having an engine, a starter housing, a starter pulley enclosed by the housing, and a transmission shift lever having a neutral setting, a reverse setting and a forward setting. The system includes a subhousing secured to the starter housing, a plunger mounted in the subhousing for reciprocal linear movement between a retracted position, and an extended position in which the plunger engages the starter pulley to prevent the rotation of the pulley, the plunger being biased in the extended position, and a cam member disposed in the subhousing to pivot between a neutral position in which the cam member overcomes the biasing force and retracts the plunger, and at least one drive gear position in which the cam member permits the extension of the plunger. Also included is an operating link connected to the transmission lever and to the cam member for selectively positioning the cam member to extend the plunger when the transmission lever is in a forward or reverse setting.

20 Claims, 2 Drawing Sheets

SHIFT INTERLOCK SYSTEM

BACKGROUND OF THE INVENTION

The present invention relates generally to starter mechanisms for internal combustion engines, and particularly to such engines designed for marine use and having reversing transmissions.

In conventional outboard marine motors, it has been possible in some cases to initiate engine starting operation when the transmission is in gear. For several reasons, including operator and passenger safety, this characteristic is undesirable. Thus, various mechanisms have been devised for preventing the starting of the engine when the transmission is in gear. Such prior art starter interlook mechanisms are disclosed in U.S. Pat. No. 3,866,591 to Burmeister et al., U.S. Pat. No. 4,167,929 to DuBois, and U.S. Pat. No. 4,534,739 to Slattery. In operation, such prior systems have been found to be less than ideal in terms of production cost, ease of assembly, and/or reliability.

Another such prior mechanism employs a cable operated lock-out system to prevent unsafe starting of the engine. However, a significant drawback of this system is that when the starter housing must be removed for service, the cable system remains attached to the engine by the cable. Thus, the cable system cannot be easily removed from the engine and impedes service operations.

A further drawback of conventional shift interlock systems is that the lock-out system must be assembled onto the starter housing after the starter housing has been mounted to the engine. This results in a complicated and awkward assembly procedure, especially in a mass-production situation.

Thus, there is a need for a shift interlock system for a marine engine which is simple in operation, economical to produce, is reliable, and permits easy disassembly for engine maintenance.

SUMMARY OF THE INVENTION

Accordingly, a shift interlock system for an outboard marine motor is provided, in which the engine is prevented from starting when the transmission is in either forward or reverse gear. Basically, the present system includes a reciprocating plunger. When the transmission is in gear, the plunger is extended, and engages a starter pulley to prevent the pulley from rotating, thus preventing the engine from starting. When the transmission is shifted to the neutral position, the plunger is retracted, permitting free movement of the starter pulley and engine starting. The plunger is actuated by the transmission shift lever through a spring-biased cam and cam follower mechanism.

More specifically, the present invention provides a shift interlock system for preventing the starting of the engine in an outboard marine motor when the transmission is in gear, the outboard motor having a starter housing, a starter pulley enclosed by the housing, and a transmission shift lever having a neutral setting, a reverse setting and a forward setting. The system includes a subhousing secured to the starter housing, and a plunger mounted in the subhousing for reciprocal linear movement between a retracted position, and an extended position in which the plunger engages the starter pulley to prevent the rotation of the pulley. A plurality of spaced tabs depend from a peripheral edge of the starter pulley, and the plunger extends into the spaces between the tabs.

The plunger is biased in the extended position. A cam member is disposed in the subhousing to pivot between a neutral position, in which the cam member overcomes the biasing force and retracts the plunger, and at least one drive gear position, in which the cam member permits the extension of the plunger. An operating link is connected to the transmission lever and to the cam member for selectively extending the plunger when the transmission lever is in a forward or reverse setting.

Thus, when the transmission is in either the forward or reverse gears, movement of the transmission lever into either gear position actuates the operating link to release the cam member and allow the plunger to extend between the starter pulley tabs. In the event that the starter pulley is positioned so that the plunger will engage one of the tabs, the pulley is allowed to rotate only enough so that the plunger will extend into the next adjacent space between tabs. Movement of the starter pulley is thus blocked, and the engine is prevented from starting. When the transmission is in the neutral position, the operating link places the cam member in engagement with the plunger to overcome the biasing force, retract the plunger from engagement with the pulley, and allow starting of the engine.

DETAILED DESCRIPTION OF THE PREFERRED EMBODIMENT

Figure 2:
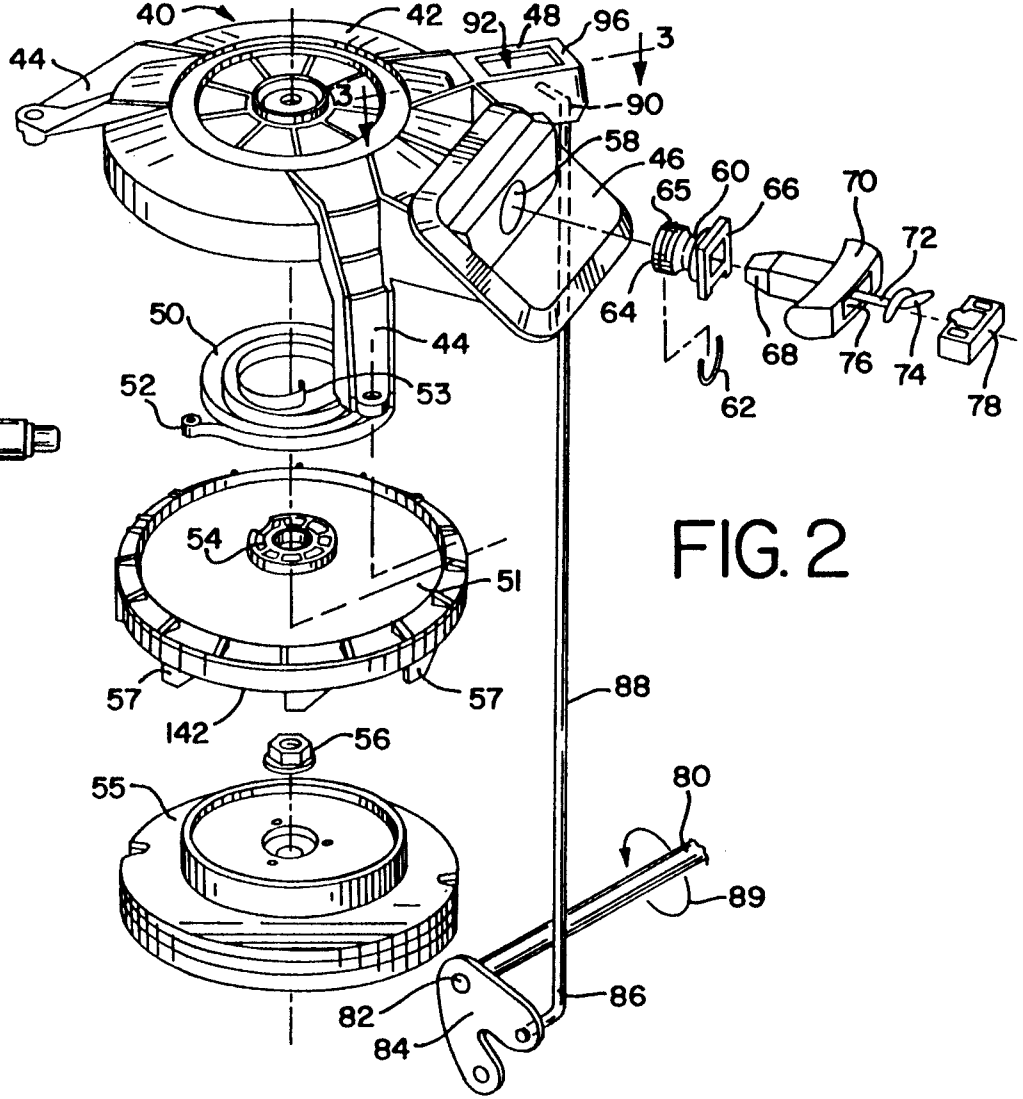
FIG. 2 is an exploded front perspective view of the outboard motor starter assembly with which the present shift interlock system may be used.
Figure 1:
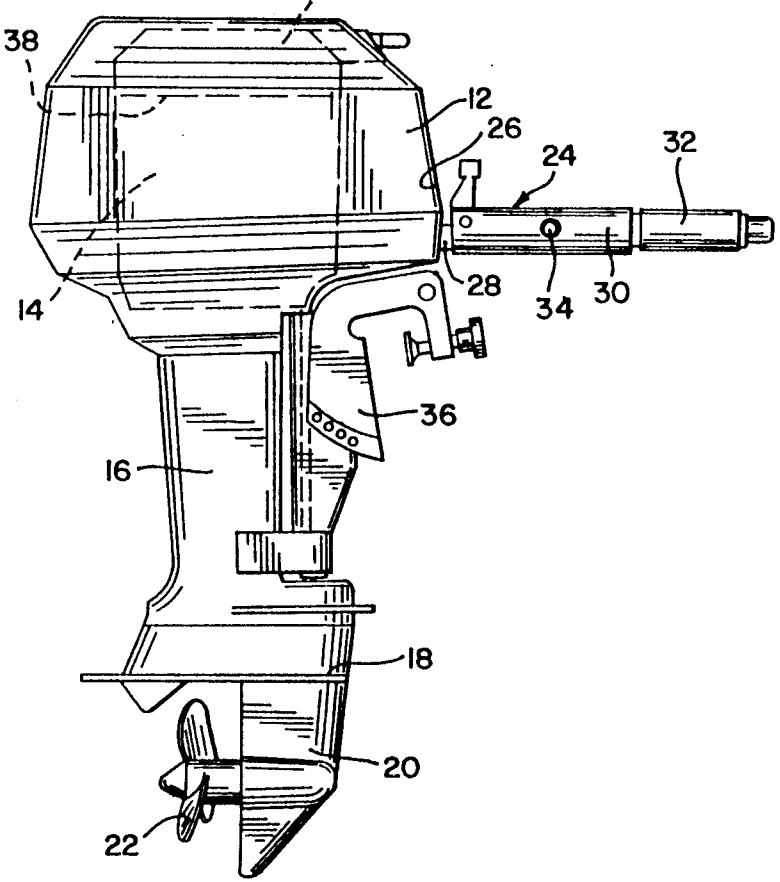
FIG. 1 is a side elevational view of an outboard motor of the type which may incorporate the present shift interlock system.

Referring now to FIGS. 1 and 2, an outboard motor is generally indicated at 10, and includes a cowl assembly 12 which encloses an internal combustion engine 14 (shown hidden). An exhaust housing 16 depends from the engine 14 and is attached at a lower end 18 o a gear case housing 20. A propeller 22 is provided at a lower rear portion of the gear case housing 20 for propelling a boat through water, as is well known. A steering handle assembly 24 is located at a front end 26 of the motor 10.

The steering handle assembly 24 includes a steering arm or bracket 28, a tiller handle 30, an axially rotatable grip portion 32, and a stop switch assembly 34. A stern bracket assembly 36 permits pivotal movement of the motor 10 and serves as the mounting point of the motor to the stern of a boat as is well known.

The engine 14 is equipped at an upper end 38 with a starter mechanism 40. The starter mechanism 40 includes a generally disk-shaped starter housing 42 having at least two and preferably three mounting legs 44 for securing the housing to the motor 10, a radially extending starter rope access formation 46, and a subhousing 48. The subhousing 48 is preferably integral with the starter housing 42. In the preferred embodiment, the starter housing 42 and the subhousing 48 are molded of high strength plastic as a single piece, although the use of other conventional configurations and materials is contemplated.

Also included in the starter mechanism 40 is a recoil spring 50 which engages a circular shaped, flattened starter pulley 51. The spring 50 is spirally wound edgewise of flat ribbon spring-stock as is known in the art. An outer end 52 of the recoil spring 50 is hooked to fit into the starter housing 42. An inner end 53 of the spring 50 is configured to engage a hub 54 of the starter pulley 51. The pulley 51 is constructed and arranged to engage and axially rotate a flywheel 55 of the engine 14. A locknut 56 secures the flywheel 55 to the engine crankshaft (not shown) as is known in the art. The pulley 51 is provided with a plurality of depending engagement formations or tabs 57 arranged in spaced intervals around the periphery of the pulley.

The starter rope access formation 46 has a central bore 58 in which a grommet 60 is secured with a spring clip 62. The grommet 60 has a first end 64 which is cylindrically shaped for engagement with the bore 58, and which includes an annular groove 65 dimensioned to receive the spring clip 62. A second end 66 of the grommet 60 has a rectangular shape dimensioned to accommodate a tapered end 68 of a starter rope handle 70. A starter rope 72 is disposed around a pulley (not shown) in the starter housing 42 to turn the starter pulley 51 as is known in the art, is passed through the grommet 60, into the starter rope handle 70, and is knotted at a free end 74 to be retained within a pocket 76 of the handle. A cap 78 is inserted into the pocket 76 to lock the knotted end 74 of the rope 72 within the handle 70 to better withstand the forces generated in pulling on the handle to start the engine 14.

A transmission shift lever 80 is shown partially in FIG. 2, and is provided at one end 82 with a link 84 to which is connected one end 86 of a vertically oriented operating link 88. The shift lever 80 may be actuated to rotate in the directions indicated by the arrow 89 between forward, reverse and neutral gear settings or positions. A second, upper end 90 (shown hidden) of the operating link 88 is bent approximately 90° for operational engagement in the subhousing 48.

Referring now to FIGS. 3–6, the subhousing 48 and its contents are depicted in greater detail, for the subhousing encloses the shift interlock system of the present invention. The shift interlock system, indicated generally at 92, basically functions to prevent rotation of the starter pulley 51 when the transmission shift lever 80 is in either the forward or reverse positions, i.e., it is in gear.

The subhousing 48 is basically a pair of spaced, parallel sidewalls 94 joined at one end by at least one bar 96 (best seen in FIG. 2). Opposite the bar 96, the sidewalls 94 are integrally joined to the starter housing 42. The subhousing 48 is generally open at the top and bottom, and the defines a track 98. In the preferred embodiment, the sidewalls 94 are slightly tapered in a cross-section taken along the horizontal axis, so that the sidewalls are relatively thinner at the bar 96.

A plunger 100 is constructed and arranged for linear reciprocal movement within the track 98 of the subhousing 48. The plunger 100 includes a pair of sidewalls 102 disposed in spaced, parallel relationship to each other. The sidewalls 102 are joined at one end to define a tubular shape 104 which is dimensioned to extend into, and retract from, an opening 106 in the starter housing 42. Opposite the tubular-shaped end 104, the sidewalls 102 are joined by an endwall having a cam shaped end 108, also referred to as the cammed end.

A cam pivot pin 110 is transversely positioned within the subhousing 48 and is inserted into a bossed opening 112 located in each subhousing sidewall 94. Each of the plunger sidewalls 102 has an elongate, generally horizontally-oriented, slot 114 through which the pivot pin 110 passes, and which allows the plunger 100 to travel in linear reciprocal fashion within the track 98 unimpeded by the pin 110.

A cam member 116 is pivotally disposed around the pivot pin 110 and within the subhousing 48 between the sidewalls 102 of the plunger 100. One end of the cam member 116 is provided with a pivot bore 118 for engaging the pin 110, and will be designated the pivot end 119. The opposite end of the cam member 116 is configured in a tapered shape 120 along a horizontal axis, this tapered shape designed to follow the cam shaped end 108 of the plunger 100. Accordingly, this tapered end of the cam member 116 will be referred to as the cam follower end 121.

The cam member 116 also includes a bore 122 adjacent the cam follower end 121 into which the bent, second end 90 of the operating link 88 is releasably inserted. Thus, as the operating link 88 is moved up or down, the cam follower end 121 of the cam member 116 will move in a similar manner.

A wall 123 depending from the subhousing 48 prevents the second end 90 of the operating link 88 from becoming detached from the cam member 116 during operation. However, one of the advantages of the present system 92 is that the operating link 88 may be readily detached from the cam member 116 when the starter housing 42 needs to be detached from the engine 14, such as for maintenance purposes.

Figure 3:
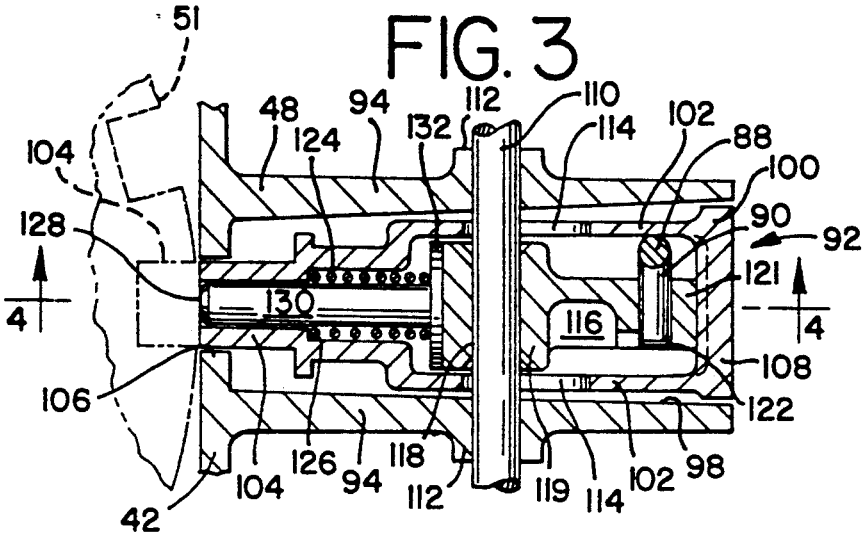
FIG. 3 is a sectional view of the present shift interlock system taken along the line 3—3 of FIG. 2 and in the direction indicated generally.
Figure 4:
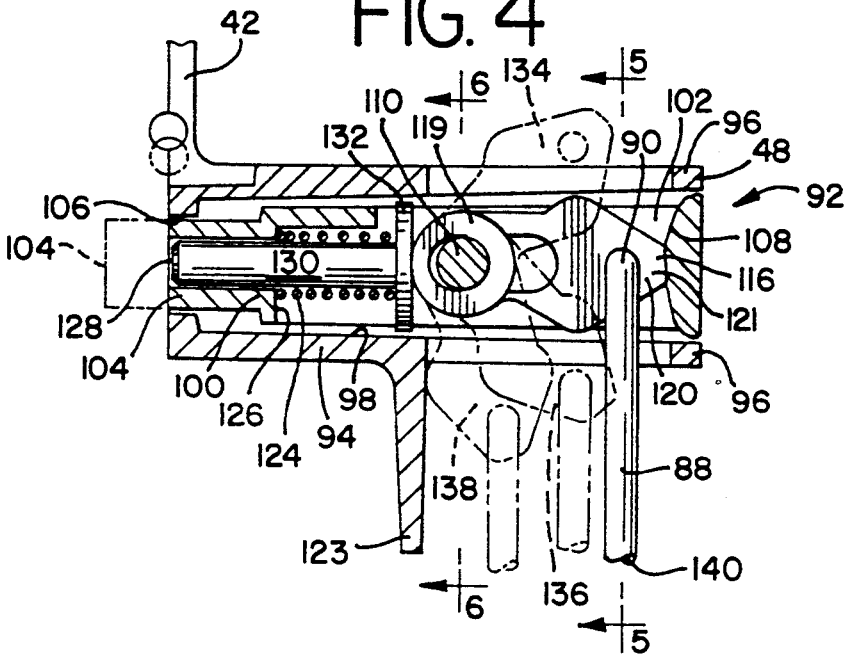
FIG. 4 is a sectional view shown partially in phantom taken along the line 4—4 of FIG. 3 and in the direction indicated generally.
Figure 5:
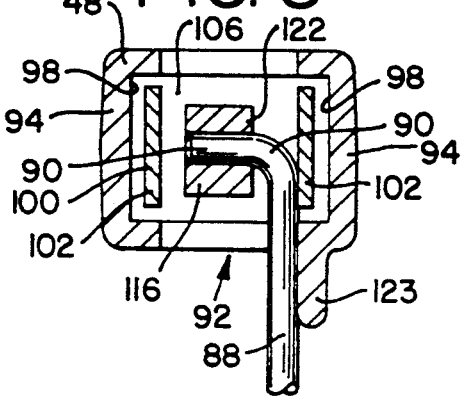
FIG. 5 is a sectional view taken along the line 5—5 of FIG. 4 and in the direction indicated generally.
Figure 6:
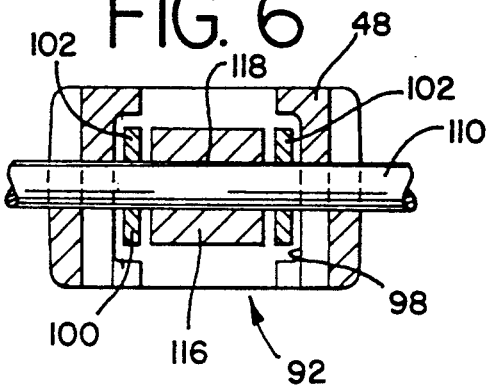
FIG. 6 is a sectional view taken along the line 6—6 of FIG. 4 and in the direction indicated generally.

The plunger 100 is subject to a biasing force which biases the tubular end 104 in an extended position (shown in phantom in FIGS. 3 and 4). In the preferred embodiment, this biasing force is provided by a coiled spring 124 positioned between the tubular end 104 and the pivot end 119 of the cam member 116. One end of the spring 124 seats against a shoulder 126 defined by the plunger sidewalls 102. The spring 124 is also held in position by a spring support 128. It is contemplated that other biasing arrangements may be employed in the alternative.

The spring support 128 has a cylindrical shaft 130 which is inserted through the spring 124 and into the hollow tubular end 104 of the plunger 100. Opposite the end of the shaft 130 located in the tubular end 104, the spring support 128 has an axially flattened head 132 which, in the preferred embodiment, is integrally joined to the shaft 130 to form a T-shape in cross-section. The head 132 contacts the pivot end 119 of the cam member 116.

In operation, and referring to FIG. 4, the operating link 88 moves upwardly from the subhousing 48 (shown in phantom at 134) when the shift lever 80 is in the reverse gear position, and moves downwardly from the subhousing (shown in phantom at 136) when the shift lever is in the forward gear position. When it is desired to detach the operating link 88 from the subhousing, i.e., for maintenance purposes, the operating link may be moved to the operating link release position, shown in phantom at 138. In this position, the bent upper end 90 of the operating link 88 may be easily withdrawn from the operating link bore 122 of the cam member 116.

The neutral position of the operating link 88 is shown in solid lines at 140. In this position, which is achieved by manipulating the shift lever 80 to the neutral position, such motion being transmitted through the link 84, to the operating link 88, and ultimately to the cam follower end 121 of the cam member 116, which is drawn across the cam shaped end 108 of the plunger 100. This action pulls the plunger 100 to the right as seen in FIG. 4, and away from the starter pulley 51, at the same time overcoming the biasing force created by the spring 124. The tubular end 104 of the plunger 100 is thus retracted from engagement with the starter pulley 51 through the opening 106 in the starter housing 42. This action allows the pulley 51 to turn and the engine 14 to start. In addition, in the retracted position, the spring 124 is under tension which is released upon the shifting of the operating link 88 into either the forward or reverse positions 136, 134, respectively.

When the operating link 88 (as well as the shift lever 80) is in either the reverse or forward gear positions 134, or 136, the cam follower end 121 of the cam member 116 is disengaged from the cammed end 108 of the plunger 100. This disengagement releases the tension on the spring 124, which then forces the tubular end 104 of the plunger 100 through the opening 106 in the starter housing 42. The tubular end 104 of the plunger 100 then becomes engaged with the starter pulley 51, and preferably becomes locked in the space between adjacent tabs 57. In the event that the plunger 100 contacts one of the tabs, either partially or head on, the starter pulley 51 is permitted limited rotational movement until the plunger 100 can extend between adjacent tabs 57. The engine 14 is thus prevented from starting until the plunger 100 is retracted from engagement with the starter pulley 51. During this operation, the spring support 128 remains generally stationary, and the tubular end 104 slides reciprocally thereon.

Thus, the present shift interlock system 92 is inexpensive to manufacture, and contains relatively few moving parts, making assembly easy and efficient. In addition, the present interlock system provides for easy disengagement of the starter housing 42 from the engine 14 when maintenance is required. By the same token, the interlock system 92 may be assembled onto the starter housing 42 prior to attachment to the engine 14.

While a particular embodiment of the shift interlock system of the invention has been shown and described, it will be appreciated by those skilled in the art that changes and modifications may be made thereto without departing from the invention in its broader aspects and as set forth in the following claims.

What is claimed is:

1. A shift interlock system for an outboard motor having an engine, a starter housing, a starter pulley enclosed by the housing, and a transmission shift lever having a neutral setting, a reverse setting and a forward setting, said system comprising:

a subhousing secured to said starter housing;

a plunger mounted in said subhousing for reciprocal linear movement between a retracted position, and an extended position in which said plunger engages one of a plurality of engagement formations on the starter pulley to prevent the rotation of the pulley;

biasing means for biasing said plunger in said extended position;

a cam member securely fastened in said subhousing in operational engagement with said plunger to pivot between a neutral position in which said cam member overcomes said biasing means and retracts said plunger, and at least one drive gear position in which said cam member permits the extension of said plunger into one of said engagement formations, and link means connected to the transmission shift lever and connected at an upper end to said cam member and being releasable from said cam member when said shift lever is in a setting other then forward, reverse, or neutral; for selectively positioning said cam member to extend said plunger into one of said engagement formations when said shift lever is in a forward or reverse setting, and when extended, said plunger preventing the starting of the engine when said plunger engages one of said engagement formations in the starter pulley.

2. The system of claim 1 further including a pivot pin mounted transversely in said subhousing to be pivotally engaged by said cam member.

3. The system of claim 2 wherein said plunger has at least one slot through which said pin passes, and which accommodates reciprocal sliding motion of said plunger relative to said pin.

4. The system of claim 1 wherein said biasing means includes a coiled spring.

5. The system of claim 4 wherein said biasing means further includes a spring support located in said subhousing for maintaining the position of said spring between said plunger and said cam member.

6. The system of claim 1 wherein said at least one drive gear position of said cam member includes a forward gear position and a reverse gear position.

7. The system of claim 6 wherein said neutral position of said cam member corresponds to the neutral setting of the transmission lever.

8. The system of claim 7 wherein said cam member pivots upwardly from said neutral position to achieve said reverse gear position, which corresponds to the reverse gear setting of the transmission lever, and downwardly from said neutral position to achieve said forward gear position, which corresponds to the forward gear setting of the transmission lever.

9. The system of claim 1 wherein the starter pulley has a plurality of spaced, depending engagement formations which are positioned to be engageable by said plunger when said plunger is extended.

10. The system of claim 1 further including guard means for preventing said link means from becoming unintentionally disengaged from said cam member.

11. The system of claim 10 wherein said guard means includes a wall depending from said subhousing.

12. The system of claim 1 wherein said subhousing includes an opening in communication with the starter housing and dimensioned to accommodate an end of said plunger when said plunger is in said extended position.

13. A shift interlock system for preventing the starting of an outboard motor when the motor is in gear, the outboard motor having an engine, a starter housing, a starter pulley enclosed by the housing, and a transmission shift lever having a neutral setting, a reverse setting and a forward setting, said system comprising:

a subhousing integral with the starter housing and in close proximity to said starter pulley;

a plunger mounted in said subhousing for reciprocal linear movement between a retracted position, and an extended position in which said plunger engages one of a plurality of depending tabs on the starter pulley to prevent the rotation of the pulley, said plunger having a tubular end and a cammed end with a generally convex cam surface;

biasing means for biasing said plunger in said extended position;

a cam member having a cam follower end for engaging said cam surface on said cammed end of said plunger, and a pivot end opposite said cam follower end, said cam member securely fastened in said subhousing to vertically pivot between a neutral position in which said cam member overcomes said biasing means and retracts said plunge, and at least one drive gear position in which said cam member permits the extension of said plunger; and an operating link connected to the transmission shift lever and connected at an upper end to said cam member and being releasable from said cam member when said shift lever is in a setting other then forward, reverse, or neutral; for selectively extending said tubular end of said plunger through an opening in the starter housing to engage one of said plurality of depending tabs on the starter pulley when the shift lever is in a forward or reverse setting, and upon engaging one of said depending tabs on the starter pulley, said extended plunger preventing the starting of the engine.

14. The system of claim 13 wherein said subhousing defines a track for said plunger.

15. The system of claim 13 wherein said plunger includes a pair of sidewalls disposed in spaced, parallel relationship to each other, one end of each of said sidewalls being connected to said tubular end, and an opposite end of each of said sidewalls being connected to said cammed end.

16. The system of claim 15 further including a pivot pin mounted transversely in said subhousing to be pivotally engaged by said pivot end of said cam member.

17. The system of claim 16 wherein each of said plunger sidewalls has at least one slot through which said pivot pin passes, and which accommodates reciprocal sliding motion of said plunger relative to said pin.

18. The system of claim 13 wherein said biasing means includes a coiled spring, and a spring support located in said subhousing for maintaining the position of said spring between said plunger and said cam member.

19. The system of claim 13 wherein said cam member further includes a bore adjacent said cam follower end configured to receive an end of said operating link.

20. The system of claim 19 wherein said operating link is connected to said cam member so that when the transmission shift lever is in the neutral setting, said cam member engages said cammed end of said plunger to retract said tubular end, and when the transmission shift lever is in either the forward setting or the reverse setting, said cam member pivots about said pin to disengage said cam follower end from said cammed end, and to allow said biasing means to extend said plunger through said opening in the starter housing to engage one of said depending tabs on the starter pulley.

* * * * *